United States Patent [19]

Nikolic

[11] 4,274,477

[45] Jun. 23, 1981

[54] RADIATOR FOR LOW-PRESSURE STEAM HEATING SYSTEMS

[76] Inventor: Zivomir Nikolic, U1.V1.Nazora 24, 51262 Kraljevica, Yugoslavia

[21] Appl. No.: 111,218

[22] Filed: Jan. 11, 1980

[51] Int. Cl.[3] ..... F28F 27/02; F24D 9/02

[52] U.S. Cl. ..... 165/101; 165/103; 165/110; 237/72

[58] Field of Search ..... 237/71, 73, 74, 70, 237/72; 165/101, 103, 110

[56] References Cited

U.S. PATENT DOCUMENTS

| | | | |
|---|---|---|---|
| 919,110 | 4/1909 | Zeck et al. | 237/72 |
| 989,751 | 4/1911 | Andrews | 165/101 |
| 1,011,438 | 12/1911 | Jones | 237/72 |
| 1,327,213 | 1/1920 | Pritchard | 237/70 |
| 1,429,413 | 9/1922 | Dodge | 165/101 |

FOREIGN PATENT DOCUMENTS

| | | | |
|---|---|---|---|
| 50641 | 9/1935 | Denmark | 165/101 |

*Primary Examiner*—Sheldon J. Richter
*Attorney, Agent, or Firm*—Fleit & Jacobson

[57] ABSTRACT

A radiator for low-pressure steam heating systems comprises at least two chambers, which constitute respective radiator elements. Consecutive elements are interconnected in an upper portion and in a lower portion. The upper portion of each element is connected to a low-pressure steam source. The lower portion of each element is connected to a condensate trap. At least individual ones of the elements are adapted to be shut off from the steam supply.

4 Claims, 2 Drawing Figures

RADIATOR FOR LOW-PRESSURE STEAM HEATING SYSTEMS

SUMMARY OF THE INVENTION

A radiator for low-pressure steam heating systems has at least two chambers, each of which is adapted to be selectively connected in its upper portion to a low-pressure steam source and is connected in its lower portion to a condensate trap.

This invention relates to a radiator for low-pressure steam heating systems. Low-pressure steam heating systems are central heating systems in which low pressure steam having a pressure of up to about 0.5 bar above atmospheric pressure is supplied to the radiators as a hot fluid. Heat is delivered by the steam as it condenses in the radiators. The resulting condensate flows back in a separate return conduit to the boiler of the heating system.

It is an object of the invention to provide such a heating system in which a higher thermal efficiency is achieved in that the heat content of the condensate is utilized too.

It is another object of the invention to improve the thermal efficiency in that individual portions or elements of the radiators or groups of radiator elements are connected to or disconnected from the system so that an improved adaptation to ambient temperatures is achieved.

Finally it is an object of the invention to provide for use in low-pressure steam heating systems a specially designed radiator with which an improved thermal efficiency and a more accurate adaptation to the ambient temperature can be achieved.

Figure 1:
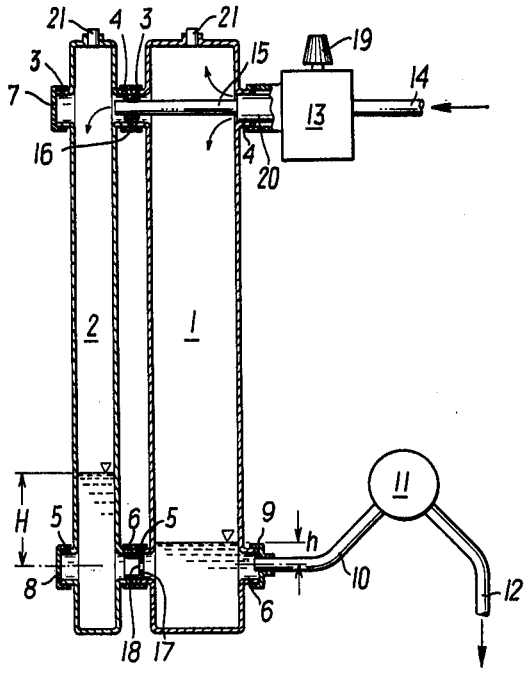
Figure 2:
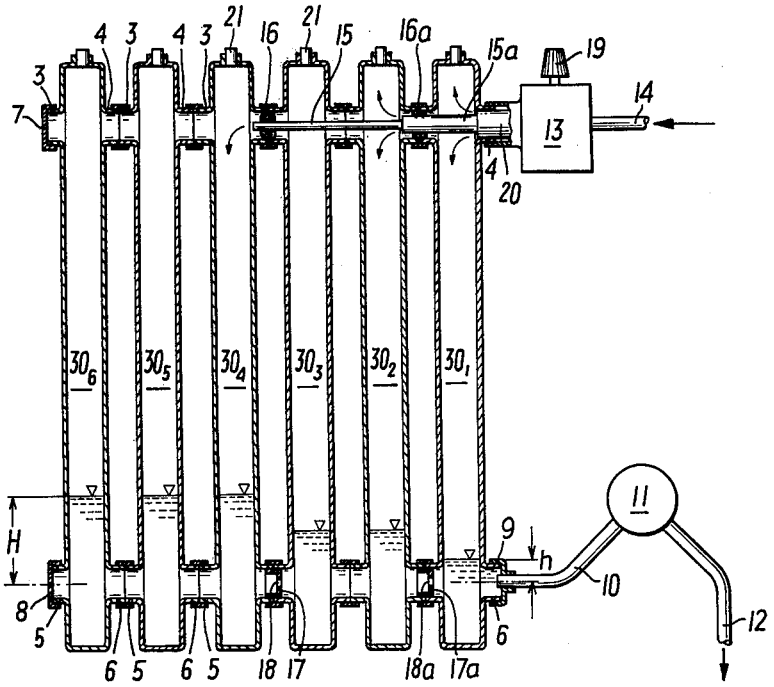

Details of such radiators for low-pressure steam heating systems will now be explained with reference to different embodiments shown in the drawings in which FIG. 1 is a simplified sectional view showing a radiator which embodies the invention and comprises two chambers differing in size and FIG. 2 is a sectional view showing a radiator which comprises a plurality of chambers or elements, which are combined in groups.

The radiator shown in FIG. 1 comprises a large first chamber 1 and a smaller second chamber 2. These two chamers may be made from sheet metal or cast iron and may consist of separate elements of ribbed radiators.

Each chamber 1 or 2 has in each of its upper and lower portions two aligned connecting pipes or nipples 3, 4 and 5,6, respectively. The two chambers 1, 2 communicate with each other because the nipples 3 and 5 of the first chamber 1 are connected to the nipples 4, 6 of chamber 2.

The nipples 3 and 5 of chamber 2 are tightly closed by caps 7, 8. The nipple 6 of chamber 1 is connected by a fitting 9 to a pipe 10, which leads to a condensate drain valve 11. The latter is connected to a drain pipe 12, in which condensate formed in the radiator is returned to the low-pressure boiler. A directional and shut-off valve 13 is secured to the nipple 4 of chamber 1 and is connected to the low-pressure steam conduit 14. The valve 13 is also connected to a pipe 15, which extends through chamber 1 and through the interconnected nipples 3 and 4 of the two chambers 1, 2. The pipe 15 is held by a seal 16, which consists of an O-ring, which is provided between the outside surface of the pipe and the inside surface of the interconnected nipples 3, 4. The seal constitutes a barrier between chambers 1 and 2.

A orifice plate 17 is provided in the lower passage formed by the interconnected lower nipples 5, 6 and is formed with a bore 18 which has a small diameter of about 5 mm or 3/16 inch and through which the two chambers 1 and 2 communicate with each other.

The directional and shut-off valve 13 has a handle 19 consisting of a lever or turning knob or handwheel or the like, which can be actuated to shut off the supply of steam from pipe 14. In another position, the valve 13 admits the supplied low-pressure steam only to the chamber 1 through an outlet 20, which is preferably concentric to the pipe 15. In a further position of valve 13, pipe 15 is also connected to the steam supply so that steam is supplied to both chambers 1, 2. In a still further position, valve 13 connects the steam supply only to the pipe 15 but not to the outlet 20 so that steam is supplied only to the chamber 2 whereas the chamber 1 is shut off.

The condensate drain valve 11 operates intermittently. It remains closed as long as the surface of the condensate formed in the chambers is below a preset level H. When the surface of the condensate has risen to the level H, the condensate drain valve 11 opens to permit condensate to drain out of chambers 1, 2 into drain pipe 12 until the surface of the condensate has subsided to a very low level h when almost all condensate has been drained. Condensate drain valve 11 then closes and remains closed until the surface of new condensate which has formed has reached the level H.

Each chamber 1 or 2 is provided at its upper end with a venting valve 21.

The radiator which has just been described has the following mode of operation.

When handle 19 has been actuated to move valve 13 to the position in which low-pressure steam from pipe 14 can flow only through outlet 20 into the larger chamber 1, the steam will condensate in chamber 1 and the resulting condensate will collect in the lower portion of chamber 1. Under the action of the steam pressure, that condensate flows through the small bore 18 of the orifice plate in nipples 5, 6 also into the smaller chamber 2 and fills the lower portion thereof. Under the superatmospheric pressure in chamber 1, the condensate will compress the steam still contained in chamber 2 and will rise therein to a higher level than in chamber 1. The still warm condensate remains in both chambers 1 and 2 and delivers its heat content to the outside. Only when the surface of the condensate in chamber 2 has reached the level H does the condensate drain valve 11 open so that the condensate contained in both chambers 1, 2 can flow back to the boiler through pipe 10, condensate drain valve 11 and drain pipe 12 until the condensate drain valve 11 closes when the surface of condensate has subsided to the level h.

The condensate drain valve can be properly adjusted so that the time in which the surface of the condensate rises to the level H, i.e. the time for which the condensate drain valve is closed, is sufficiently long for the condensate to deliver a major part of its heat content and to be cooled to a temperature which is only slightly above room temperature.

If a lower quantity of heat is sufficient to heat the room in which the radiator is installed, e.g. to hold the room at a lower temperature at night, the handle 19 can be actuated so that low-pressure steam is supplied only to chamber 2, which is smaller than chamber 1, as has been described. In that case, steam for filling the chamber 2 is withdrawn from conduit 14 at a lower rate than before. Owing to the smaller volume of chamber 2, condensate will form at a somewhat lower rate than when steam is supplied to the larger chamber 1. Part of the resulting condensate flows from chamber 2 through bore 18 of orifice plate 17 into chamber 1 and for the reasons explained hereinbefore the surface of the condensate in chamber 1 will rise to a higher level in chamber 1 than in chamber 2. Because condensate is formed at a lower rate, the surface of the condensate in chamber 1 rises more slowly so that a longer time than in the previously explained case will elapse until the surface of the condensate has reached the level H at which the condensate drain valve 11 opens. As a result, the condensate can deliver heat for a longer time and will be cooled to a lower temperature than in the previous case. This is in accordance with the lower room temperature which is desired.

When the surface of the condensate reaches the level H, the condensate drain valve 11 operates as described hereinbefore.

When heat is required at a high rate because the open-air temperature is low, the handle 19 is actuated to connect both chambers to the low-pressure steam conduit 14. Owing to the communication between chambers 1, 2 through the small bores 18, the condensate will rise in both chambers to the same level in this case until its surface has reached the level H. At that time, the condensate drain valve 11 opens so that the condensate can flow back to the boiler as has been explained hereinbefore.

The radiator which is shown in a sectional view consists of six entirely identical heating elements $30_1$ to $30_6$. These heating elements form groups of one, two and three heating elements, respectively. Adjacent heating elements are held together by nipples 3, 4 and 5,6. Like the two chambers 1, 2 of the previously described embodiment, these three groups have different cubic capacities.

The same reference characters as in FIG. 1 have been used in FIG. 2 for the other parts of the radiator shown in FIG. 1. The design of the radiator of FIG. 2 is highly similar to that of FIG. 1.

The nipples 3, 5 of the last element $30_6$ at the left-hand end in FIG. 2 are closed by caps 7, 8. The lower nipple 6 of the first element $30_1$ on the right in FIG. 2 is connected by the fitting 9 to the pipe 20, which leads to the condensate drain valve 11, which is connected to the drain pipe 12. A directional and shut-off valve 13 is secured to the nipple 4 of the first element $30_1$ and is connected to the steam supply conduit. A handle 19 or the like serves to actuate the valve 13. A pipe 15 connected to the valve 13 extends through elements $30_1$, $30_2$ and $30_3$ and opens into the element $30_4$, which communicates with elements $30_5$ and $30_6$. The pipe 15 is sealed by an O-ring 16 in the upper nipples 3, 4 of elements $30_3$ and $30_4$. Also connected to valve 13 is a pipe **15*a*, which concentrically surrounds the pipe 15 and extends only through the element $30_1$. The pipe 15*a* is sealed by an O-ring 16*a* in the nipples 3, 4 of elements $30_1$ and $30_2$ and opens into the element $30_2$, which communicates with the next element $30_3$. The pipe 15*a* is surrounded on the outside by the connecting pipe 20, which extends from the valve 13** and opens into the first element $30_1$.

Orifice plates 17 and **17*a* are installed between elements $30_1$ and $30_2$ and between elements $30_3$ and $30_4$, respectively and have respective small bores 18 and 18*a***, respectively.

This radiator comprises three sections, which are comparable to the two chambers 1 and 2 of the embodiment described first.

Each of the elements $30_1$ to $30_6$ is provided at its top with a venting valve 21.

This radiator is similar in its mode of operation to the radiator which has been described first but can be more exactly adjusted to the ambient or open-air temperature. For this purpose the valve 13 can be actuated by handle 19 so that only the element $30_1$ or both elements $30_2$ and $30_3$ or the group consisting of elements $30_4$, $30_5$ and $30_6$ can be connected to the live steam supply conduit 14. Thereafter, element $30_1$ can be connected in addition to the last-mentioned group, also the group consisting of the elements $30_2$ and $30_3$, and finally that group and also the first element $30_1$. In this way, a single element (element $30_1$) or two or three or four or five elements or all six elements can be connected to deliver heat.

The surface of the condensate in the elements $30_1$ to $30_6$ reaches the levels indicated in FIG. 2 when the valve 13 is in the position in which only the first element $30_1$ is connected to the low-pressure steam conduit 14 and all other elements are shut off from said conduit.

What is claimed is:

1. A radiator for use with low-pressure steam heating systems, comprising at least two series of heating elements, each series having at least one heating element, upper and lower means for consecutively interconnecting said elements in upper and in lower portions thereof, means for independently interconnecting an upper portion of an element of each of said series to a low pressure steam source and for selectively disconnecting at least one of said series from the steam source, condensate drain valve means for maintaining condensate level in said elements higher than the level of said lower means for consecutively interconnecting lower portions of said elements to each other, and means for connecting said lower portions of each of said elements to said condensate drain valve means.

2. A radiator as set forth in claim 1, characterized in that said upper and lower means comprise mutually opposite connecting pipes aligned with each other provided in upper and lower portions of said elements.

3. A radiator as set forth in claim 1, characterized in that said means for independently interconnecting and for selectively disconnecting comprises a separate pipe connecting an element of each series to a low-pressure steam conduit, and a common directional valve connected to said pipes, said valve being selectively operable to connect at least one selected pipe to the steam conduit.

4. A radiator as set forth in claim 1, further comprising an orifice plate having a small diameter orifice, and characterized in that the lower portion of at least individual ones of adjacent elements from different ones of said series communicate only through the orifice plate.

* * * * *